US005984302A

United States Patent [19]

Garrone

[11] Patent Number: 5,984,302

[45] Date of Patent: Nov. 16, 1999

[54] EQUIPMENT FOR SUPPLYING SHEETS TO A FOLDING MACHINE

[75] Inventor: Vittorio Garrone, San Mauro Torinese, Italy

[73] Assignee: Gera S.r.l., Torino, Italy

[21] Appl. No.: 09/037,612

[22] Filed: Mar. 10, 1998

[30] Foreign Application Priority Data

| | | | |
|---|---|---|---|
| Mar. 12, 1997 | [IT] | Italy | TO97A0204 |
| Jun. 13, 1997 | [EP] | European Pat. Off. | 97201794 |

[51] Int. Cl.[6] ..... B65H 7/02

[52] U.S. Cl. ..... 271/227; 271/185

[58] Field of Search ..... 271/227, 228, 271/185

[56] References Cited

U.S. PATENT DOCUMENTS

| | | | |
|---|---|---|---|
| 4,445,679 | 5/1984 | Bay . | |
| 4,928,807 | 5/1990 | Auerbach | 271/185 |
| 5,788,228 | 8/1998 | Moll | 271/227 |

FOREIGN PATENT DOCUMENTS

| | | | |
|---|---|---|---|
| 0 512 827 | 11/1992 | European Pat. Off. . | |
| 000579057 A1 | 1/1994 | European Pat. Off. | 271/185 |
| 356048344 | 5/1981 | Japan | 271/227 |
| 62-96246 | 5/1987 | Japan | 271/227 |
| 62-0201753 | 9/1987 | Japan | 271/185 |
| 62-244847 | 4/1988 | Japan . | |

*Primary Examiner*—H. Grant Skaggs

*Attorney, Agent, or Firm*—Sughrue, Mion, Zinn, Macpeak & Seas, PLLC

[57] ABSTRACT

Equipment for advancing sheets having at least one rectangular format from a plotter or photocopier to a folding machine comprises two conveyor belts and means for temporarily reversing the direction of movement of one of the two belts in order to rotate the sheet through 90°, this reversal being achieved by reversing the sense of rotation of the motor which drives the belts.

6 Claims, 6 Drawing Sheets

EQUIPMENT FOR SUPPLYING SHEETS TO A FOLDING MACHINE

DESCRIPTION

The subject of the present invention is equipment for supplying sheets having at least one rectangular format from a printer or photocopier to a folding machine.

The equipment is of the type comprising a conveyor plane for the sheets, a pair of endless conveyor belts arranged parallel to the direction of advance of the sheets and having their upper passes adjacent the conveyor plane, a plurality of balls spaced from each other and supported so as to be rotatable above each belt so that their weight presses on the sheet on the two conveyor belts, activatable means for causing the sheet to rotate through 90°, activatable means for stopping the advance of the sheet in a predetermined position, and sensor means carried by the conveyor plane for recognising the orientation of at least one format of the sheet and, should the orientation not be correct, for actuating the stop means and the means for causing the rotation of the sheet through 90°.

Equipment of the type specified above is known from U.S. Pat. No. 4,445,679.

In the equipment described in this patent, the means for causing the rotation of the sheet about its centre through 90° are constituted by the at least one pair of rollers which move the sheet in a direction perpendicular to the direction of transport. One of the rollers is mounted in a fixed position above the conveyor plane and the other roller is driven and is supported beneath the surface of the conveyor plane so as to be raised and lowered.

This solution is however rather complicated and expensive.

The object of the present invention is to provide equipment of the type specified above which enables the sheet to be rotated simply and economically with the use of the same motor as that which drives the conveyor belts for driving the rotation.

This object is achieved by virtue of the characteristic which forms the subject of the characterising part of claim 1.

Figure 1:
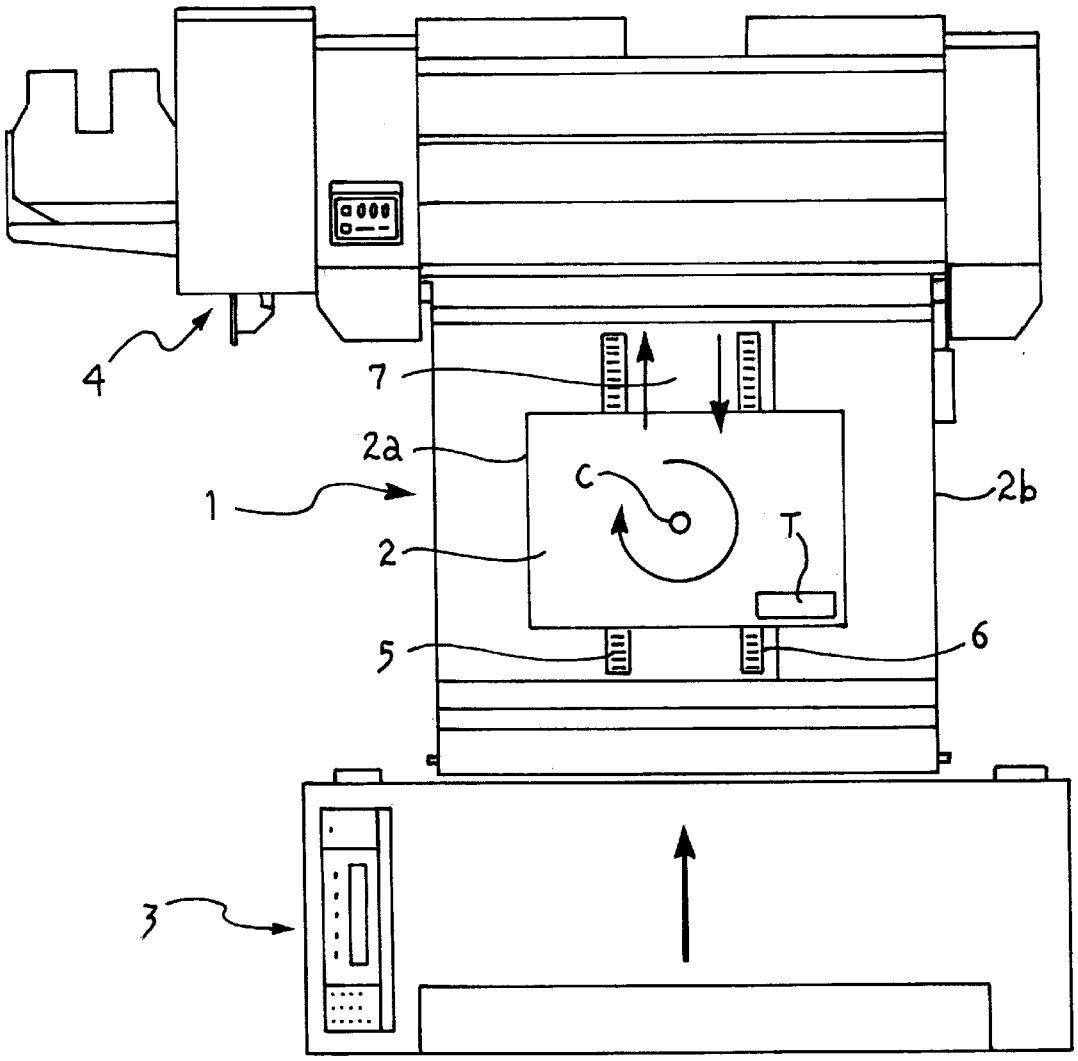
Figure 2:
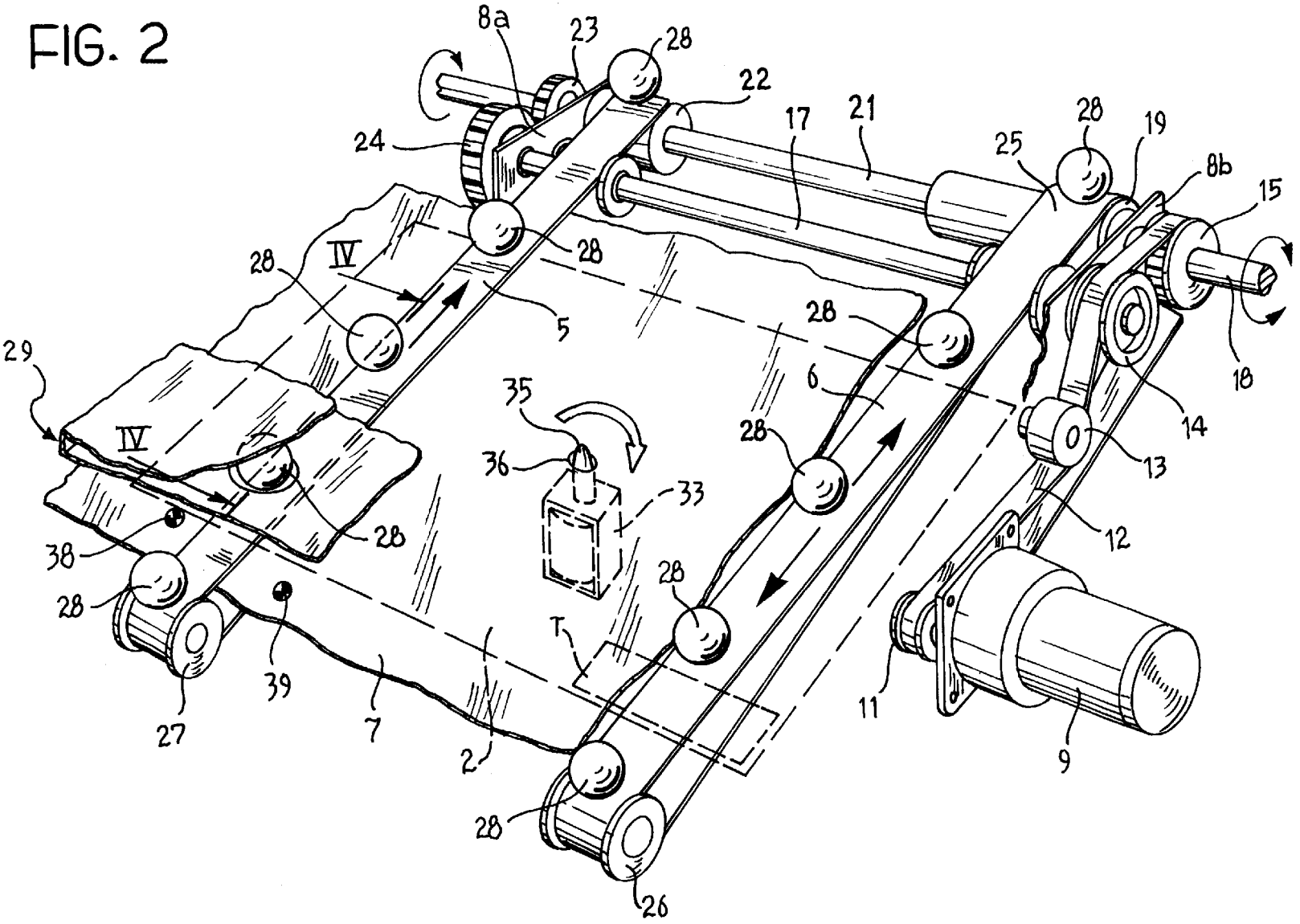
Figure 3:
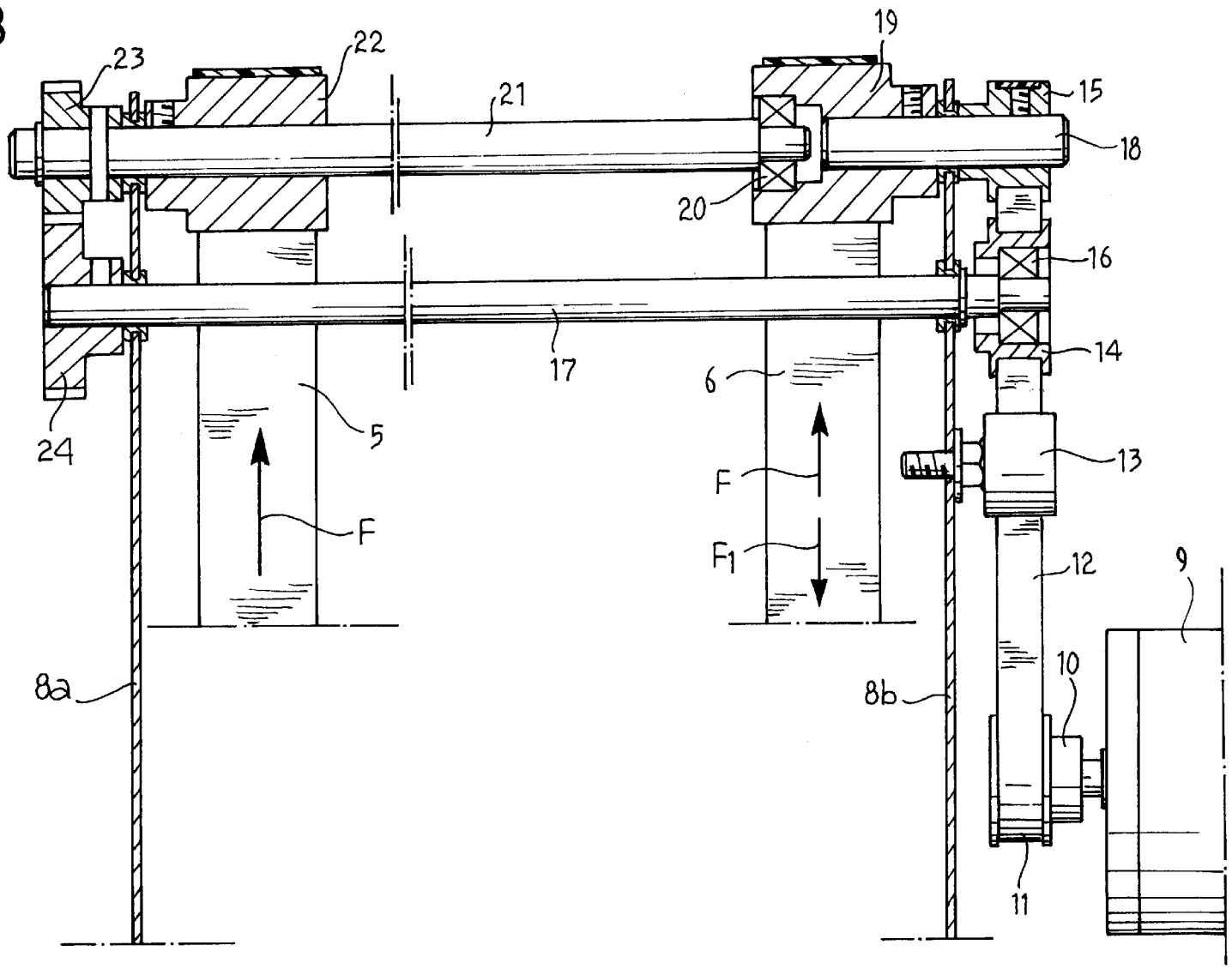
Figure 4:
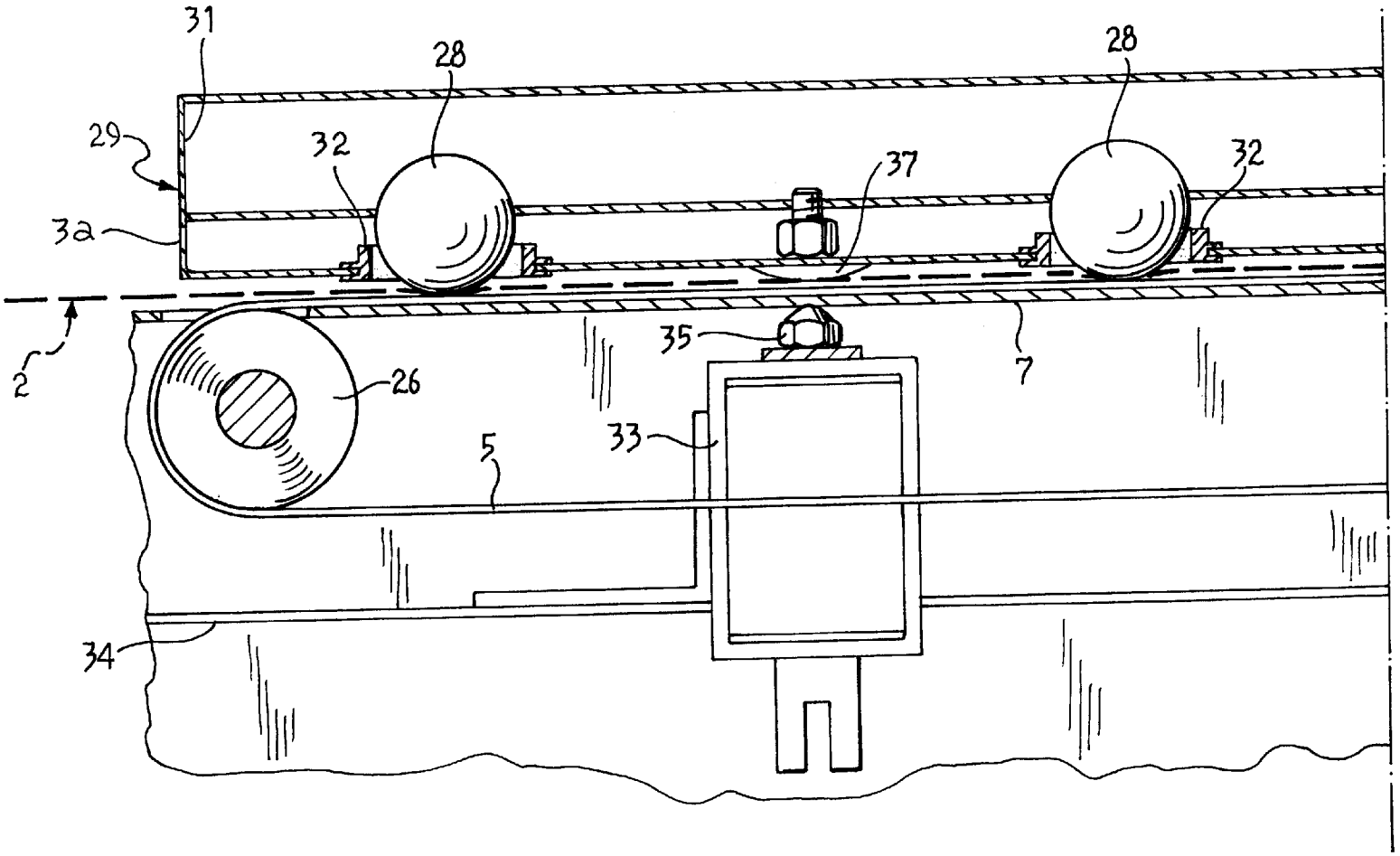
Figure 5:
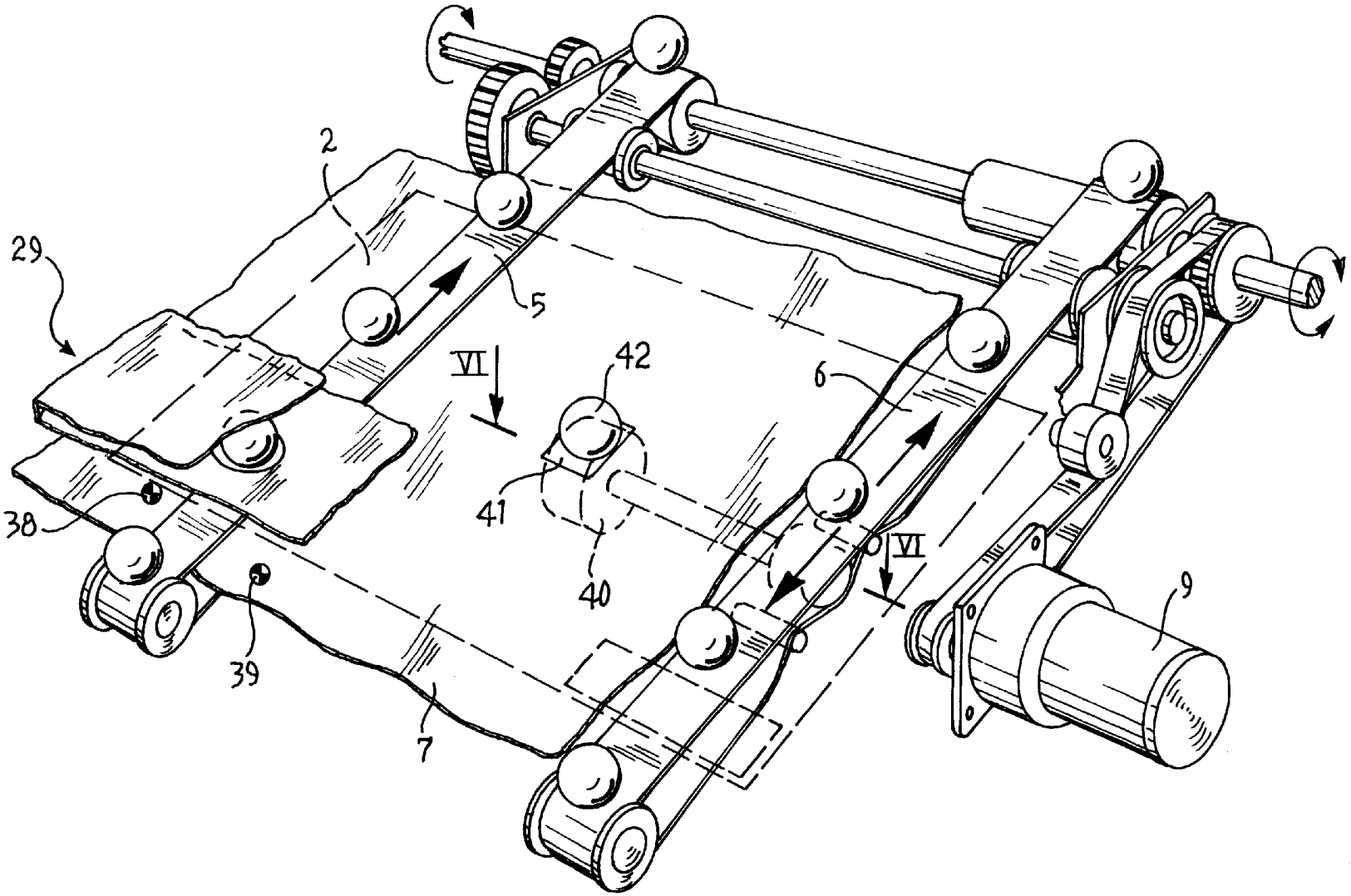
Figure 6:
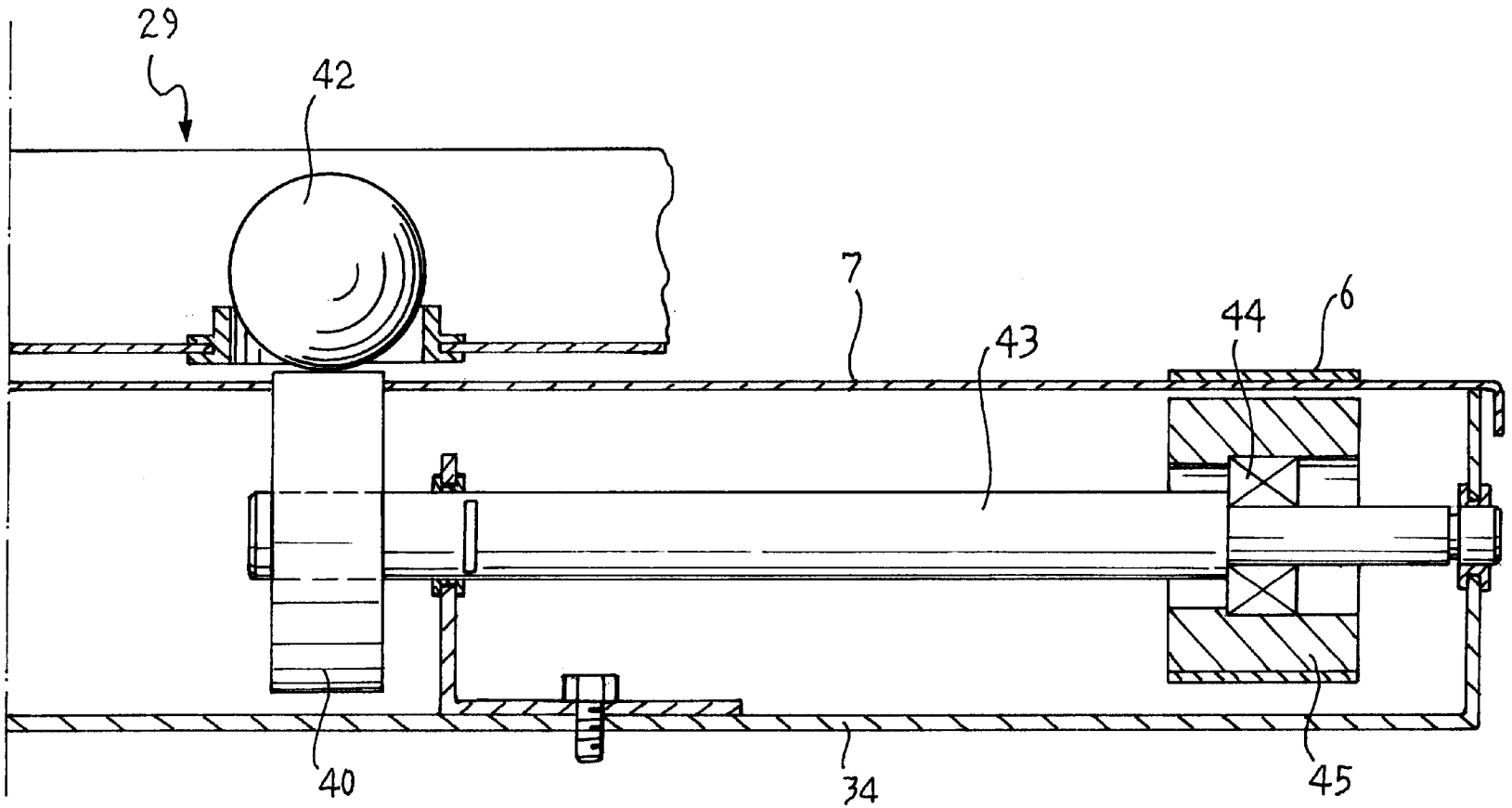

Further characteristics and advantages of the present invention will become apparent from the description which follows with reference to the appended drawings, in which:

FIG. 1 is a schematic plan view illustrating the location of the equipment of the invention, FIG. 2 is a perspective view of the operative members of the equipment, FIG. 3 is a partial plan view, partially in section, showing the equipment illustrated in FIG. 1, FIG. 4 is a section taken on the line IV—IV of FIG. 3 on an enlarged scale, FIG. 5 is a view similar to FIG. 2 illustrating a variant of the stop means for the sheet, and FIG. 6 is a section taken on the line VI—VI of FIG. 5 on an enlarged scale.

In FIG. 1 the equipment according to the invention is generally indicated 1 and is used for the transport of a rectangular sheet 2 carrying a technical design and a table T between a plotter 3 or a photocopier and a folding machine 4.

The sheet 2 is transported by means of two endless belts 5, 6, the upper passes of which slide on a conveyor plane 7.

The two belts 5, 6 are parallel to each other and the rectangular sheet 2 has two opposite sides 2*a*, 2*b* parallel to the belts 5, 6.

In the case in which, as illustrated in FIG. 1, the two sides 2*a*, 2*b* of the sheet 2 are constituted by the shorter sides of the rectangle, the sheet must be rotated through 90° about its centre C before it is introduced into the folding machine 4 in order to ensure that, after folding, the table T is correctly oriented.

This result is achieved with the equipment illustrated in FIGS. 2 to 4.

The equipment includes a support structure including two side walls 8*a*, 8*b*.

The side wall 8*b* supports, through a support not illustrated, an electric motor 9 the drive shaft 10 whereof can rotate in opposite senses.

To the shaft 10 is keyed a pulley 11 over which passes a toothed belt 12. The upper pass of the belt 12 passes beneath an idle roller 13 and drives the rotation of two pulleys 14 and 15.

The pulley 14 is mounted, with the interposition of a free wheel 16, on a shaft 17 supported for rotation by the two side walls 8*a*, 8*b*.

The free wheel 16 is made in such a manner that the pulley 14 transmits drive to the shaft 17 only when the pulley 14 rotates in the anti-clockwise sense.

The pulley 15 is keyed to a shaft 18 rotatably supported in the side wall 8*b*.

To the shaft 18 is keyed, adjacent the side wall 8*b*, a first pulley 19 connected through a free wheel 20 to one end of a shaft 21 co-axial with the shaft 18.

A second pulley 22 is keyed to the shaft 21 adjacent the side wall 8*a*.

To the end of the shaft 21 which projects outwardly from the side wall 8*a* is keyed a gear 23 which meshes with a gear 24 keyed to the end of the shaft 17 which projects outwardly from the side wall 8*a*.

The conveyor belt 6 passes over the pulley 19 and at its other end passes over a return pulley 26.

The conveyor belt 5 passes over the pulley 22 while its other end passes over a return pulley 27.

The upper passes of the two belts 5, 6 slide, as stated above, on a conveyor plane 7 and the sheet 2 rests on these belts and on the conveyor plane.

The sheet 2 is pressed on the belts 5, 6 by metal balls 28 contained in a housing 29 supported, in a manner not illustrated, above the conveyor plane 7. The housing 29 comprises a lower part 30 and a removable cover 31.

The base of the part 30 has a circular aperture in correspondence with each ball 28 the edge of which supports a guide bush 32 having an inner diameter such as to retain the ball 28.

The balls 28 are driven to rotate when the sheet 2 is displaced as a result of the movement of the belts 5 and 6.

An electromagnet supported in a central position by a horizontal plate 34 located beneath the lower pass of the conveyor belts 5 and 6 is indicated 33.

The movable core of the electromagnet 33 is indicated 35 and, when the electromagnet is energised, moves upwardly and, passing through an aperture 36 in the conveyor plane 7, presses the sheet 2 against a convex abutment element 37 fixed to the base of the part 30 of the housing 29.

Two electronic sensors are indicated 38 and 39 and are constituted, for example, by photo-electric cells carried by the upper surface of the conveyor plane 7. The position of the sensors 38 and 39 depends on the format of the sheet 2.

When sheets of different formats from that illustrated are used, further pairs of sensors disposed in appropriate positions are required for each further format.

The device described above operates as follows.

When the motor 9 rotates in a clockwise sense, the belt 12 causes the pulley 14 to rotate in the clockwise sense which does not transmit drive to the shaft 17 because of the free wheel 16. The belt 12 also causes the pulley 15 to rotate in the clockwise sense and, through the shaft 18, drives the pulley 19.

Through the free wheel 20, the pulley 19 rotates the shaft 21, the pulley 22 and the gear 23. The gear 23 rotates the shaft 17 in the anti-clockwise sense through gear 24. The free wheel 16 prevents the shaft 17 from transmitting drive to the pulley 14.

In this situation, the pulleys 19 and 22 drive the respective belts 5 and 6 to move in the direction of advance of the sheet, that is, in the direction of the arrows F of FIG. 3.

When the sheet 2 which is advancing uncovers the sensor 38, the motor 9 is made to rotate in the anti-clockwise sense, preferably and at a greater speed. In this case, the belt 12 makes the pulley 14 rotate in the anti-clockwise sense and, through the free wheel 16, transmits drive to the shaft 17. The shaft 17, through the pair of gears 24, 25, makes the shaft 21 rotate in the clockwise sense which drives the rotation of the pulley 22. The shafts 21 does not transmit drive to the pulley 19 because of the free wheel 20. The belt 12, through the pulley 15 and the shaft 18, makes the pulley 19 rotate in the anti-clockwise sense. The free wheel 20 prevents the pulley 19 from transmitting drive to the shaft 21, rotating in the clockwise sense.

Simultaneously with the reversal of the sense of rotation of the motor 9, the electromagnet 33 is energised and its movable core 35 clamps the sheet 2 against the abutment element 37.

In this situation, the pulley 22 drives the respective belt 5 to move, still in the direction of advance of the sheet, that is, in the direction of the arrow F, while the pulley 19 drives the movement of the belt 6 in the direction of the arrow $F_1$, that is in the opposite direction from that of advance of the sheet, at the same speed as the belt 5.

As a result of the movements of the two belts 5, 6 in opposite directions, the sheet 2 is made to rotate in the clockwise sense about a vertical axis passing through the point of contact between the core 35 and the abutment 37.

During the rotation of the sheet, it is always subject to the pressure of the balls 28. When the sheet 2, as a result of its rotation, covers the sensor 39, which corresponds to a rotation of the sheet through 90°, the sense of rotation of the motor 9 is again reversed and the electromagnet 33 is de-energised, whereby the sheet 2 is supplied to the folding machine 4 in the correct position, that is, with its longer sides parallel to the direction of advance.

In a variant, the core 35 of the electromagnet 33 has solely the function of stopping the sheet and does not provide an axis of rotation since the electromagnet 33 is energised only for an instant, whereby its core 35 is lowered immediately the movement of the two belts in the opposite directions starts, which in itself suffices to cause the sheet to rotate about the centre of the sheet itself.

In this case the electromagnet 33 has solely the stoppage function and could even be replaced by other movable stop means located, for example, so as to co-operate with the front edge of the sheet.

In the variant illustrated in FIGS. 5 and 6, the electromagnet 33 has been eliminated and replaced by a roller 40, the upper part of which passes through an aperture 41 in the conveyor plane 7. The roller 40 is in contact with the sheet 2 which is pressed against the roller by the action of a central ball 42 rotatably supported in the housing 29 in a manner similar to the balls 28.

The roller 40 is carried by one end of a shaft 43 rotatably supported by the lower structure 34. The shaft 43 is connected at its other end, through a free wheel 44, to a roller 45 which is rotated by the lower pass of the belt 6.

The free wheel 44 enables the roller 45 to cause the rotation of the shaft 43 only when the upper pass of the belt 6 moves in the direction of advance of the sheet 2, that is, when the motor 9 rotates in the clockwise sense. When the motor 9 reverses its sense of rotation and the belt 6 reverses its movement relative to that of the belt 5 to cause the rotation of the sheet 2 through 90°, the free wheel 44 no longer allows the roller 45 to drive the rotation of the shaft 43, whereby the roller 40 stops and its point of contact with the ball 42 defines the position of the vertical axis of rotation of the sheet 2.

Hence, in this case, the activation and de-activation of the stop element for stopping the advance of the sheet does not require a suitable command since these are commanded automatically by the reversal of the sense of rotation of the motor 9.

What is claimed is:

1. In equipment for conveying sheets having at least one rectangular format along a direction of advance from a printer or photocopier and for delivering them with said format in a predetermined current orientation to a folding machine, comprising:

means defining a conveyor plane for said sheets, a pair of endless conveyor belts arranged parallel to said direction of advance of said sheets and having their upper passes adjacent said conveyor plane, a plurality of balls;

means for supporting said plurality of balls in mutually spaced relationship above said conveyor belt so as to be rotatable and so that their weight presses each said sheet on to said conveyor belts, activatable means for causing said sheets to rotate through 90°, activatable stop means for stopping said advance of said sheets in a predetermined position, and sensor means carried by said conveyor plane for recognising the orientation of said at least one format of said sheets and for actuating said stop means and said means for causing the rotation of said sheet through 90° should said orientation not be said correct orientation, the improvements whereby said means for causing said rotation of said sheets through 90° comprise means for temporarily reversing the direction of movement of one of said two conveyor belts.

2. Equipment according to claim 1, wherein said means for temporarily reversing the direction of movement of said one of said two conveyor belts comprise:

an electric drive motor having two senses of rotation, sensor means operable to control the switching of said drive motor from one to the other of said senses of rotation, transmission means for transmitting drive from said drive motor to said two belts, said transmission means being such that, when said drive motor rotates in one sense, said transmission transmits drive to said two belts to move them in the same direction and cause the advance of said sheet and, when said drive motor rotates in the opposite sense, said transmission transmits drive to said two belts to move them in opposite directions from each other.

3. Equipment according to claim 2, wherein means are provided to control said drive motor to rotate at a greater speed when said two belts move in opposite directions than when said two belts move in the same direction.

4. Equipment according to claim 2, wherein, when the said sensor means control the switching of said drive motor, one of said two belts reverses its direction of movement and said activatable stop means are activated by said one belt.

5. Equipment according to claim 4, wherein said equipment includes:

a stop roller, a shaft carrying said stop roller, a free wheel connected to said shaft, a roller connected to said shaft through said free wheel, said roller being rotatable by the lower pass of said belt which reverses its direction of movement, said stop roller acting at the centre of a said sheet pressed against said conveyor plane by a said rotatable ball and said free wheel being operative to transmit drive to said stop roller only when said belt which reverses direction moves in the same direction as the other of said two belts.

6. Equipment according to claim 1, wherein said transmission comprises:

a drive belt driven by said electric drive motor, a first pulley driven by said drive belt, a first shaft, a first free wheel connecting said first pulley and said first shaft so as to enable drive to be transmitted from said first pulley to said first shaft only when said first pulley rotates in the anti-clockwise sense, a second pulley driven by said drive belt, a second shaft parallel to said first shaft and driven by said second pulley and having first and second ends, a third pulley keyed to said first end of said second shaft, a second free wheel, a third shaft co-axial with said second shaft, said second free wheel allowing the transmission of drive from said third pulley to said third shaft only when said third pulley rotates in the clockwise sense, said third pulley driving a first of said two conveyor belts, a fourth pulley keyed to said third shaft, the second of said two conveyor belts being driven by said fourth pulley, a first gear keyed to said third shaft, a second gear keyed to said first shaft and meshing with said first gear, whereby, when said drive motor rotates in the clockwise sense, said third pulley and said fourth pulley drive said two conveyor belts in the direction of advance of said sheets while, when said drive motor rotates in the anti-clockwise sense, said third pulley reverses its sense of rotation and drives the respective conveyor belt in the opposite direction from said direction of advance of said sheets while said fourth pulley continues to drive its belt in the direction of advance of said sheets.

* * * * *

UNITED STATES PATENT AND TRADEMARK OFFICE

CERTIFICATE OF CORRECTION

PATENT NO. : 5,984,302

DATED : November 16, 1999

INVENTOR(S) : Vittorio Garrone

It is certified that error appears in the above-identified patent and that said Letters Patent is hereby corrected as shown below:

On the Title Page,

Item [30] delete "T097A204" and insert --T097A000204-- and
Delete "June 13, 1997 [EP] European Pat. Off. 97201794".

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*